United States Patent [19]

Takimoto et al.

[11] 4,450,816

[45] May 29, 1984

[54] METHOD AND APPARATUS FOR CONTROLLING THE FUEL INJECTION AMOUNT OF AN INTERNAL COMBUSTION ENGINE

[75] Inventors: Toshiyuki Takimoto, Susono; Takehisa Yaegashi, Mishima, both of Japan

[73] Assignee: Toyota Jidosha Kogyo Kabushiki Kaisha, Toyota, Japan

[21] Appl. No.: 333,775

[22] Filed: Dec. 23, 1981

[30] Foreign Application Priority Data

Dec. 23, 1980 [JP] Japan ..... 55/181212

[51] Int. Cl.[3] ..... F02B 3/00

[52] U.S. Cl. ..... 123/492; 123/493

[58] Field of Search ..... 123/478, 492, 493

[56] References Cited

U.S. PATENT DOCUMENTS

| | | | |
|---|---|---|---|
| 4,112,879 | 9/1978 | Assenheimer | 123/492 |
| 4,184,458 | 1/1980 | Aoki | 123/492 |
| 4,227,507 | 10/1980 | Takase | 123/492 |
| 4,240,383 | 12/1980 | Horbelt | 123/492 |
| 4,359,991 | 11/1982 | Stumpp | 123/492 |

*Primary Examiner*—Donald B. Cox

*Attorney, Agent, or Firm*—Cushman, Darby & Cushman

[57] ABSTRACT

The volumetric efficiency of an internal combustion engine is calculated from the detected flow rate of the intake air and from the detected rotational speed. The changing rate of the calculated volumetric efficiency is restricted to a limit rate. Then, the amount of fuel to be injected into the engine is calculated, depending upon the restricted volumetric efficiency.

5 Claims, 13 Drawing Figures

METHOD AND APPARATUS FOR CONTROLLING THE FUEL INJECTION AMOUNT OF AN INTERNAL COMBUSTION ENGINE

BACKGROUND OF THE INVENTION

The present invention relates to a method and apparatus for controlling the amount of fuel to be injected into an internal combustion engine.

There is an internal combustion engine wherein the fuel injection amount is controlled in response to an electrical detection signal from an air-flow sensor which detects the flow rate of intake air by using a mechanical moving element, the displacement of which corresponds to the flow rate. In an engine of this type, if the flow rate of the intake air increases rapidly, owing to, for example, the rapid opening of the throttle valve, the inertia of the mechanical moving element causes the detection signal from the air-flow sensor to overshoot. If the air-flow detection signal overshoots, since an excess amount of fuel is transiently supplied to the engine, the air-fuel ratio condition of the mixture is rapidly changed to the rich side with respect to the stoichiometric condition for a short time. This transient change of the air-fuel ratio to the rich side is often called a "rich spike". When the rinch spike occurs, the operator of the engine receives a great torque shock during the transient acceleration (hereinafter called an "acceleration shock") and the amount of the HC and CO components in the exhaust gas extremely increase.

SUMMARY OF THE INVENTION

It is, therefore, an object of the present invention to provide a method and apparatus for controling the fuel injection amount, whereby the magnitude of the acceleration shock can be reduced and the amount of the HC and CO components emitted from the engine can be reduced when the flow rate of intake air is rapidly increased.

According to the present invention, a method of controlling the amount of fuel injected into an internal combustion engine, comprises the steps of; detecting the flow rate of intake air sucked into the engine and the rotational speed of the engine; calculating the volumetric efficiency of the engine from the detected flow rate of the intake air and from the detected rotational speed; restricting the changing rate of the volumetric efficiency to a certain rate, hereinafter called a limit rate; and adjusting, in response to the restricted volumetric efficiency, the amount of fuel to be injected into the engine. Furthermore, an apparatus according to the present invention comprises: means for detecting the flow rate of intake air sucked into the engine and for detecting the rotational speed of the engine; processing means for (1) calculating the volumetric efficiency of the engine from the detected flow rate of the intake air and from the detected rotational speed and (2) restricting the changing rate of the volumetric efficiency to a limit rate; and means for adjusting, in response to the restricted volumetric efficiency, the amount of fuel to be injected into the engine.

The above and other related objects and features of the present invention will be apparent from the description of the present invention set forth below, with reference to the accompanying drawings, as well as from the appended claims.

DETAILED DESCRIPTION OF THE PREFERRED EMBODIMENTS

Figure 1:
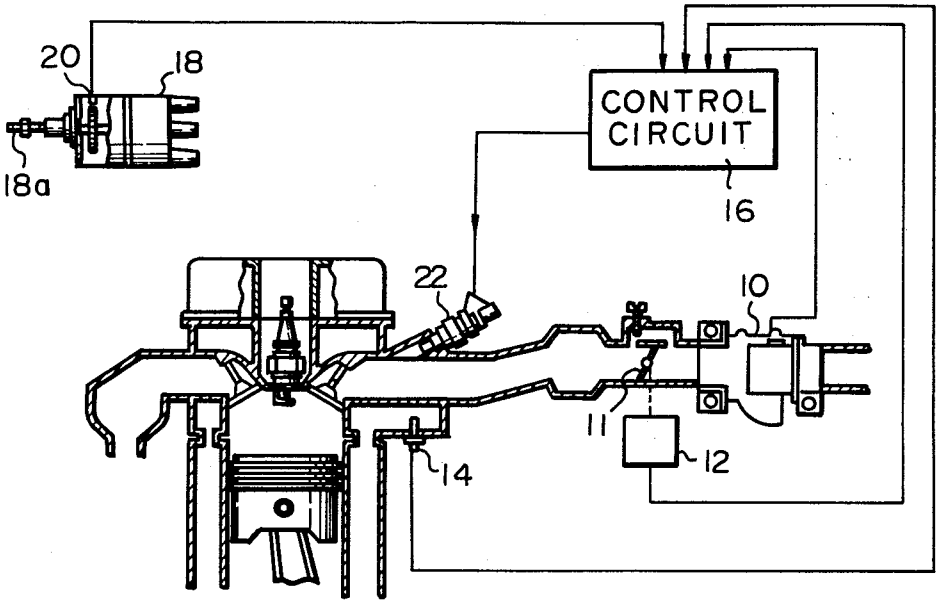
FIG. 1 is a schematic diagram illustrating an electronic fuel injection control system of an internal combustion engine, according to the present invention.

Referring to FIG. 1, reference numeral 10 denotes an air-flow sensor which detects the flow rate of intake air sucked into the engine and produces a voltage inversely proportional to the detected flow rate. A throttle sensor 12 connected to a throttle shaft of a throttle valve 11 produces a voltage depending upon the opening degree of the throttle valve 11. A coolant temperature sensor 14 detects the coolant temperature and produces a voltage depending upon the detected temperature. The output voltages from the air-flow sensor 10, the throttle sensor 12, and the coolant temperature sensor 14 are fed to a control circuit 16.

A distributor 18 of the engine is equipped with a crank angle sensor 20 which generates an angular position signal every time the distributor shaft 18*a* rotates by a predetermined angle, for example, by 30° in terms of the crank angle. The angular position signal from the crank angle sensor 20 is fed to the control circuit 16.

The control circuit 16 feeds an injection signal to a fuel injection valve 22. The fuel injection valve 22 opens, depending upon the duration of the injection signal, to inject the compressed fuel that is supplied from a fuel supply system (not shown) into the intake port.

Figure 2:
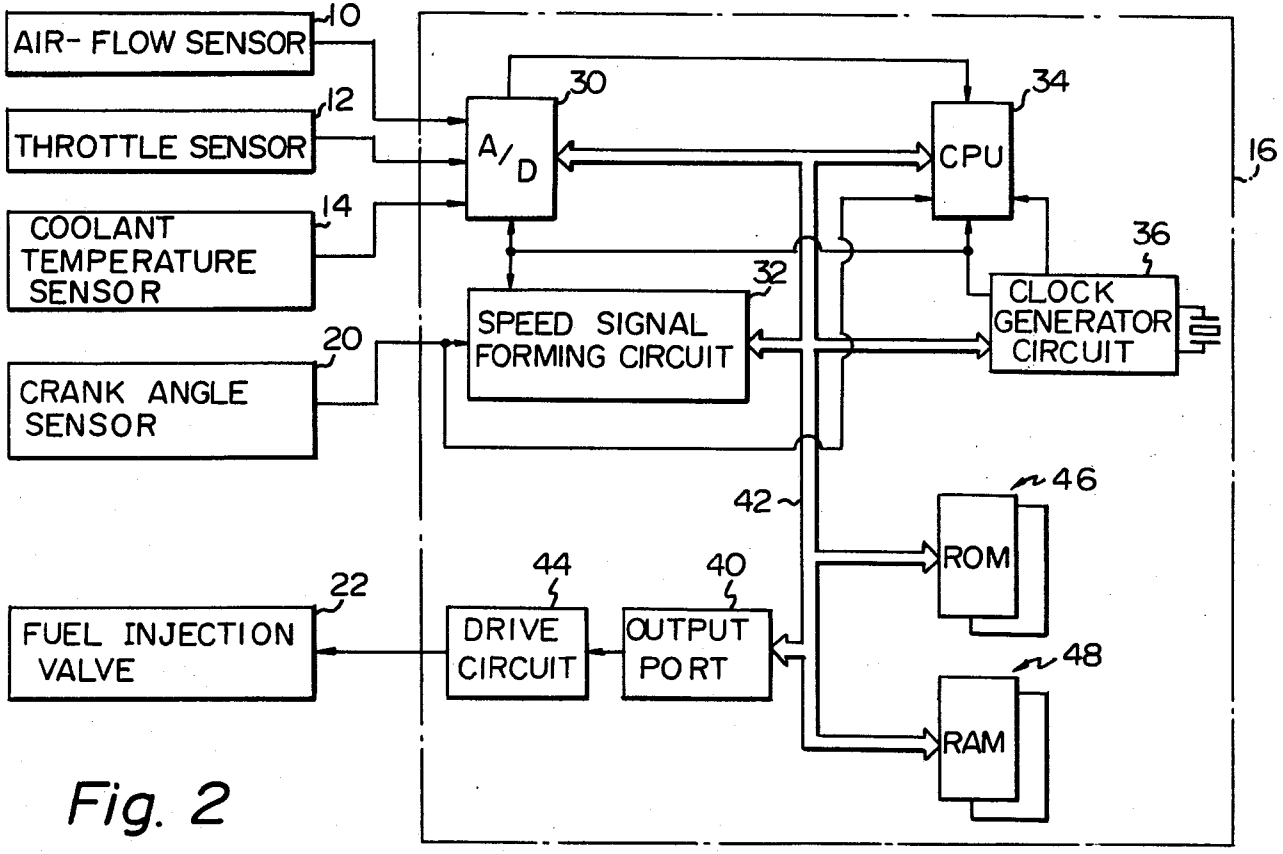
FIG. 2 is a block diagram illustrating the control circuit shown in FIG. 1.

FIG. 2 is a block diagram illustrating an example of the control circuit 16 of FIG. 1.

Output voltages from the air-flow sensor 10, throttle sensor 12 and coolant temperature sensor 14 are fed to an analog to digital (A/D) converter 30, having the functions of an analog multiplexer and a converter, and are converted into binary signals in sequence at a predetermined conversion interval.

The angular position signal produced by the crank angle sensor 20 at every crank angle of 30° is fed to a speed-signal forming circuit 32, and furthermore to a central processing unit (CPU) 34 as an interrupt request signal. As is widely known, the speed-signal forming circuit 32 has a gate that opens and closes in response to the angular position signal, and a counter which counts the number of clock pulses that pass through the gate each time the gate is opened. Thus, the speed-signal forming circuit 32 forms a binary speed signal having a value which corresponds to the rotational speed of the engine.

An injection signal having a pulse-width $T_{EFI}$ is fed to a predetermined bit position of an output port 40 from the CPU 34 via a bus 42. Then, the injection signal is sent to the fuel injection valve 22 via a drive circuit 44. Accordingly, the fuel injection valve 22 is energized for a time corresponding to the pulse-width $T_{EFI}$, and the fuel, in an amount corresponding to the injection pulse-width $T_{EFI}$, is supplied to the engine.

The A/D converter 30, the speed-signal forming circuit 32, and output port 40 are connected via the bus 42 to the CPU 34, read-only memory (ROM) 46, random access memory (RAM) 48, and clock generator circuit 36, which constitute the microcomputer. The input/output data are transferred through the bus 42.

Although not shown in FIG. 2, the microcomputer is further provided with an input/output control circuit and a memory control circuit, in the customary manner.

A program for executing the main processing routine, that will be mentioned later, and a variety of data and constants necessary for executing the processing have been stored beforehand in the ROM 46.

Below is briefly mentioned the processing steps, in conjunction with FIG. 3, for controlling the fuel injection using the microcomputer. When the power-supply circuit is turned on, the CPU 34 executes an initializing routine 43 to reset the content of the RAM 48 and to set the constants to initial values. The program then proceeds to a main routine 45 which repetitively executes the calculation of the amount of fuel injection, that will be mentioned later. The CPU 34 further executes an interrupt routine 47 responsive to the crank angle interrupt signal produced at every crank angle of 30° to form an injection signal and sends it to the output port 40, or executes an interrupt routine 49 responsive to a timer interrupt signal produced at every predetermined period to form the injection signal and sends it to the output port 40.

While the main processing routine is being executed or while some other interrupt routine is being executed, the CPU 34 introduces the new data, that represents the rotational speed N of the engine, received from the speed-signal forming circuit 32, and stores it in a predetermined region in the RAM 48. Further, relying upon the A/D conversion interrupt routine, executed at every predetermined period of time or at every predetermined crank angular position, the CPU 34 introduces the new data that represents the flow rate Q of the intake air, the new data that represents the degree of the opening of the throttle valve 11, and the new data that represents the coolant temperature THW and stores these new data in predetermined regions of the RAM 48.

Figure 3:
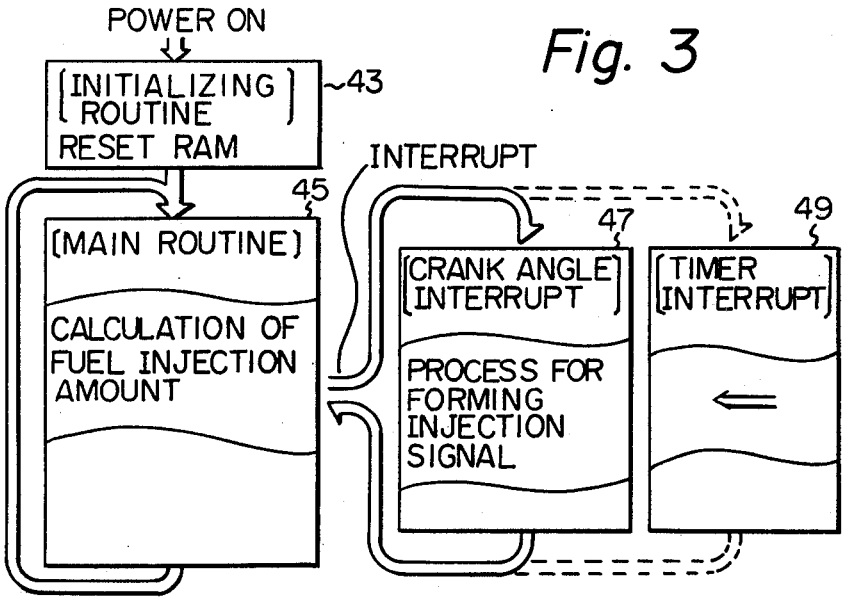
FIG. 3 is a schematic diagram illustrating the process of a microcomputer in the control circuit.
Figure 4:
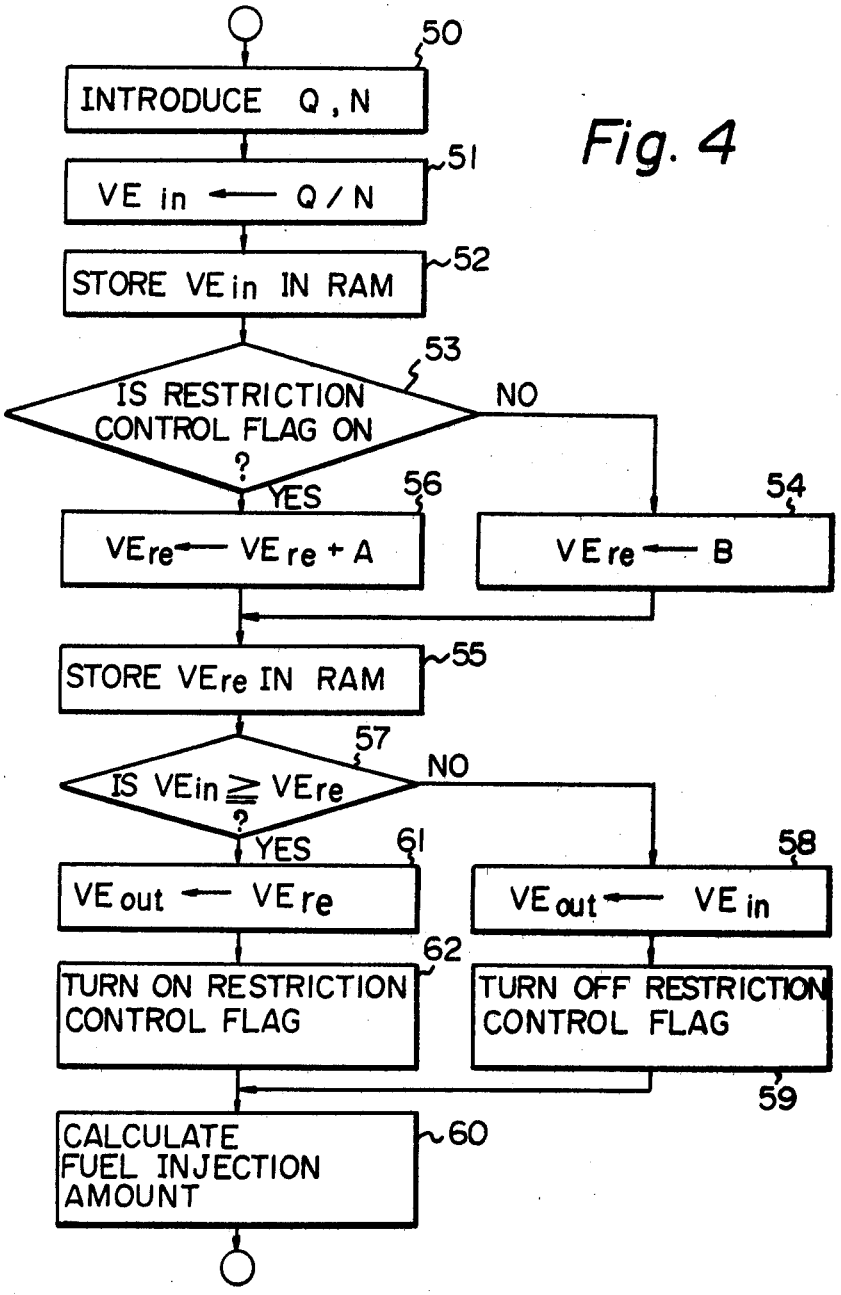
FIG. 4 is a flow diagram illustrating a part of the control program of the microcomputer.

FIG. 4 illustrates a flow diagram of a part of the main routine 45 of FIG. 3.

At a point 50, the CPU 34 introduces the input data with respect to the rotational speed N and the intake air flow rate Q from the RAM 48. At a point 51, a volumetric efficiency $VE_{in}$ is calculated from a relationship of $VE_{in}=Q/N$, and then the calculated volumetric efficiency $VE_{in}$ is stored in a predetermined region of the RAM 48 at a point 52.

At a point 53, the CPU 34 discriminates whether or not a restriction control with respect to the changing rate of the volumetric efficiency is now being executed. This discrimination is carried out by checking a restriction control flag. If not, the program proceeds to a step 54 where a variable restriction value $VE_{re}$ of the volumetric efficiency is reset to an initial value (predetermined fixed value) B. Then, at the next point 55, the initialized restriction value $VE_{re}$ is stored in a predetermined region of the RAM 48. If the restriction control is now executed, the restriction value $VE_{re}$ obtained in the previous step is increased by a fixed increment factor A to form a new restriction value $VE_{re}$, at a point 56. Namely, at the point 56, the calculation of $VE_{re} \leftarrow VE_{re}+A$ is executed. Then, the obtained restriction value $VE_{re}$ is stored in the RAM 48 at the point 55. At a point 57, the CPU 34 discriminates whether or not the volumetric efficiency $VE_{in}$ calculated from the input data is equal to or larger than the restriction value $VE_{re}$. If $VE_{in}<VE_{re}$, namely, if the changing rate of the volumetric efficiency is less than a certain rate (limit rate) which is determined depending upon the increment factor A and upon the repeating period of the main routine, the program proceeds to a point 58, where the volumetric efficiency value $VE_{out}$ is equalized to the calculated volumetric efficiency $VE_{in}$. Then, at a point 59, the restriction control flag is turned off; thereafter, at a point 60, the fuel injection amount is calculated by using the obtained volumetric efficiency value $VE_{out}$. Namely, in this case, the calculated volumetric efficiency $VE_{in}$ is used for calculation of the fuel injection amount (injection pulse-width). The injection pulse-width $T_{EFI}$ is, in general, calculated from an expression of $$T_{EFI}=VE_{out}\cdot K\cdot\alpha\cdot\beta+T_v$$

where K is a constant, $\alpha$ and $\beta$ are coefficients related to the coolant temperature correction, to the air-fuel ratio feedback correction, and to the acceleration correction, and $T_v$ is an ineffective injection pulse-width of the fuel injection valve 22.

If $VE_{in}\geqq VE_{re}$ at the point 57, namely, if the changing rate of the volumetric efficiency is equal to or larger than the limit rate, the program proceeds to a point 61, where the volumetric efficiency value $VE_{out}$ is equalized to the restriction value $VE_{re}$. Then, at a point 62, the restriction control flag is turned on, so as to recognize that the restriction control is now executed. Thereafter, at the point 60, the injection pulse-width is calculated by using the obtained value $VE_{out}$ which is now equal to the restriction value $VE_{re}$.

Figure 5:
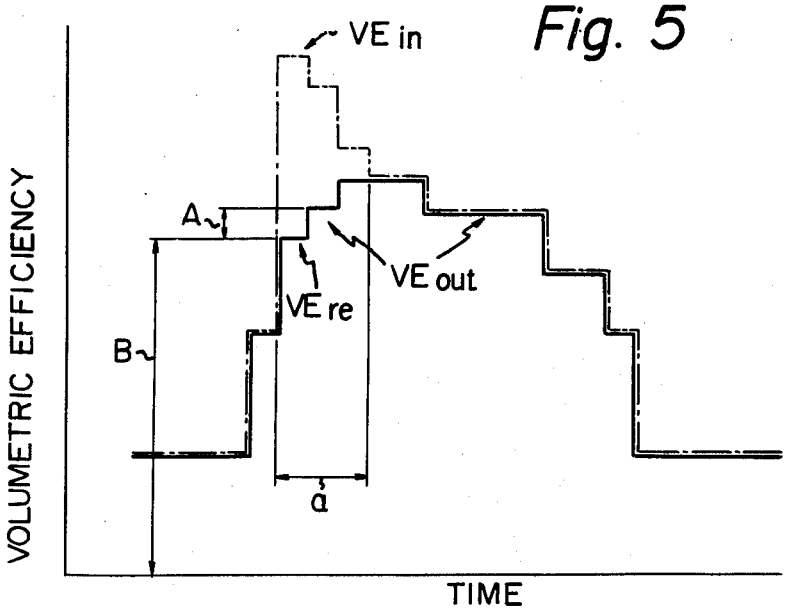
FIG. 5 is a graph of the volumetric efficiencies $VE_{in}$, $VE_{re}$ and $VE_{out}$ versus the time.

FIG. 5 illustrates the operations of the processing routine of FIG. 3. In FIG. 5, the abscissa indicates time, and the ordinate indicates the volumetric efficiency. In a case where the volumetric efficiency $VE_{in}$ calculated from the input data exceeds the predetermined value B, the restriction control operation is initiated. This restriction control operation continues until the calculated volumetric efficiency $VE_{in}$ is lowered less than the variable restriction value $VE_{re}$, as shown by a in FIG. 5. During the restriction control operation, the volumetric efficiency value $VE_{out}$, which is actually used for calculation of the injection pulse-width, is restricted to the restriction value $VE_{re}$. This restriction value $VE_{re}$ has the initial predetermined value of B and stepwise increases by the value A at every operation cycle of the routine of FIG. 4 during the restriction control operation. When the calculated volumetric efficiency $VE_{in}$ becomes lower than the restriction value $VE_{re}$, the restriction control operation is stopped and the calculation of the injection pulse-width is carried out by using the calculated volumetric efficiency $VE_{in}$ as $VE_{out}$.

According to the above-mentioned restriction control, the changing rate of the volumetric efficiency is restricted to a limited value when the flow rate of intake air is rapidly increased. As a result, rich spikes can be prevented from occurring at the rapid increase of the intake air flow rate.

Figure 6A:
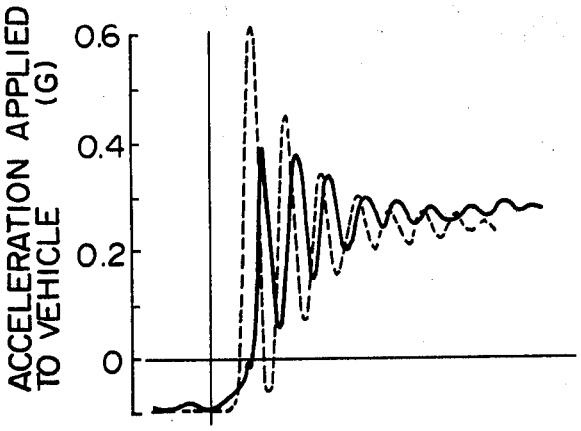
FIGS. 6(A) and (B) are graphs of the acceleration applied to the vehicle and the injection pulse width, versus the time, respectively.
Figure 6B:
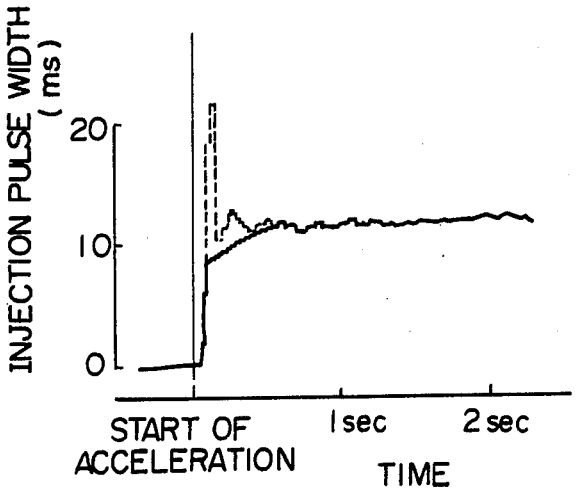

FIGS. 6 and 7 illustrate the effects of the above-mentioned embodiment. FIG. 6(A) indicates the characteristics of forward and backward acceleration applied to a vehicle with respect to time, and FIG. 6(B) indicates characteristics of the injection pulse-width with respect to time. According to the conventional control system, when the accelerating operation is initiated and thus the flow rate of the intake air is rapidly increased, the injection pulse-width is transiently and rapidly increased, as shown by a broken line in FIG. 6(B). Therefore, as shown by a broken line in FIG. 6(A), the forward and backward acceleration applied to the vehicle changes greatly, causing great acceleration shocks to occur. According to the present invention, however, since the above-mentioned restriction control is executed, the injection pulse-width does not overshoot at the initiation of the accelerating operation, as shown by a solid line in FIG. 6(B). Therefore, the amplitude of the vibration of the acceleration applied to the vehicle can be decreased, as shown by a solid line in FIG. 6(A), and thus the acceleration shock can be decreased.

Figure 7A:
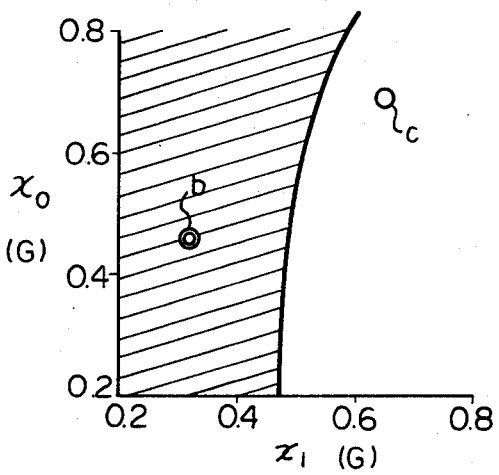
FIGS. 7(A) and (B) are graphs illustrating a permitted limit of the acceleration shock.
Figure 7B:
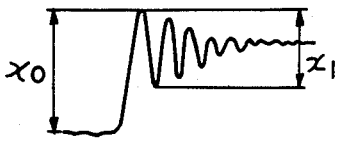

FIG. 7(A) illustrates a permitted limit of the acceleration shock. A shaded portion in FIG. 7(A) indicates the range of the permitted acceleration shock. In FIG. 7(A), the ordinate indicates the difference $x_o$ between the acceleration value applied to the vehicle before the accelerating operation and the maximum acceleration value applied to the vehicle at first just after the accelerating operation, as shown in FIG. 7(B), and the abscissa indicates the difference $x_1$ between the above maximum acceleration value and the next occurring minimum acceleration value applied to the vehicle during the accelerating operation, as shown in FIG. 7(B). According to the aforementioned embodiment, the acceleration shock can be conttrolled within the shaded portion of FIG. 7(A) as indicated by b. If no restriction control for restricting the changing rate of the volumetric efficiency is carried out, the acceleration shock will exceed the permitted limit, as indicated by c in FIG. 7(A).

Figure 8:
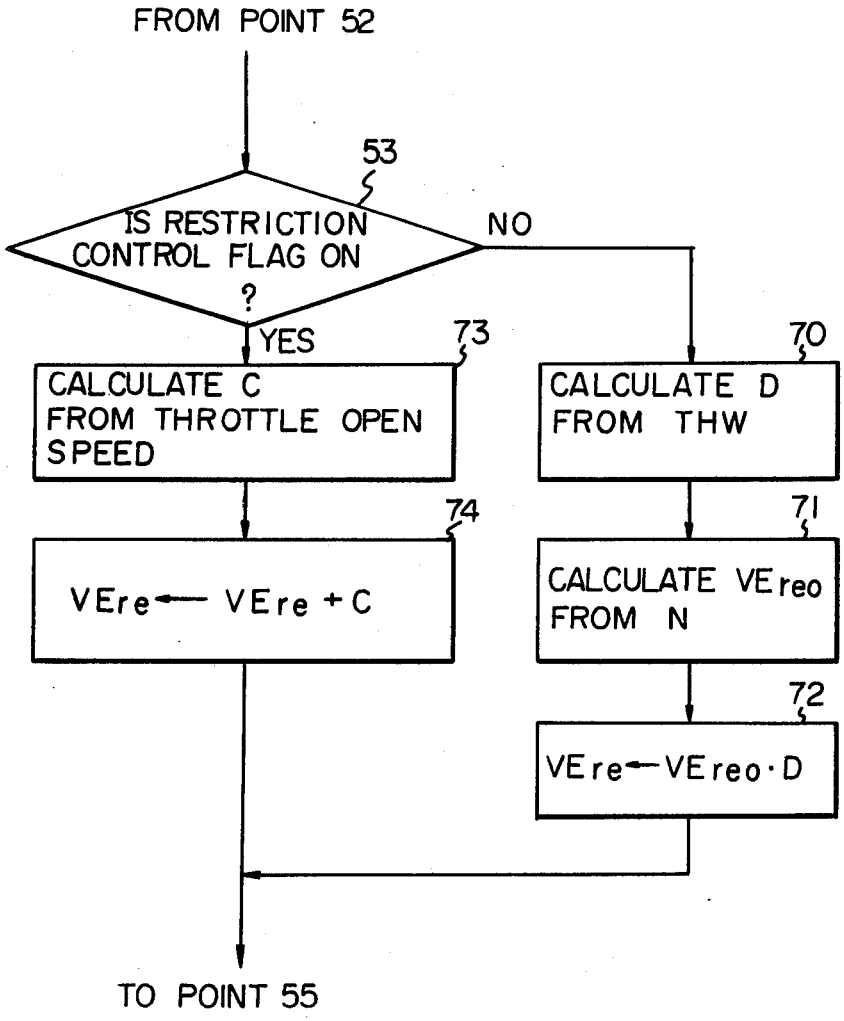
FIG. 8 is a flow diagram illustrating a part of another control program of the microcomputer.

FIG. 8 illustrates a part of another example of the main processing routine of FIG. 3. In FIG. 8, only a portion of the routine different from that of FIG. 3 is illustrated.

Figure 9:
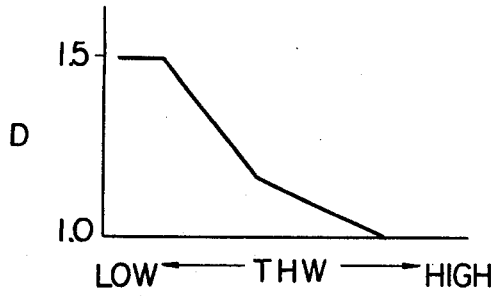
FIG. 9 is a graph of the factor D versus the coolant temperature THW.
Figure 10:
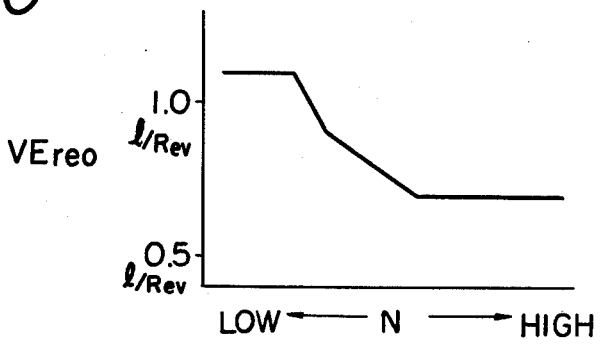
FIG. 10 is a graph of the restricted volumetric efficiency $VE_{reo}$ versus the rotational speed N.

If it is discriminated, at the point 53, that the restriction control operation is not executed, the program proceeds to a point 70 where a coolant temperature correction factor D is calculated from the input data with respect to the coolant temperature THW, which data has been stored in the RAM 48. In the ROM 46, a function which represents a relationship between the coolant temperature THW and the correction factor D, as shown in FIG. 9, is previously stored in the form of an algebraic expression or map. At the point 70, the factor D is calculated from the coolant temperature THW by using this function. At a point 71, a variable initial value $VE_{reo}$ of the restriction value $VE_{re}$ is calculated from the input data with respect to the rotational speed N, which data is stored in the RAM 48. In the ROM 46, a function representing a relationship between the variable initial value $VE_{reo}$ and the rotational speed N, as shown in FIG. 10, is previously stored in the form of an algebraic expression or map. At the point 71, the initial value $VE_{reo}$ is calculated from the rotational speed N by using the above function. Then, at a point 72, the restriction value $VE_{re}$ with respect to the volumetric efficiency is equalized to a product of the calculated initial value $VE_{reo}$ and the calculated factor D. Namely, the process of $VE_{re} \leftarrow VE_{reo} \cdot D$ is executed at the point 72. Thereafter, the program proceeds to the point 55 of FIG. 4.

Figure 11:
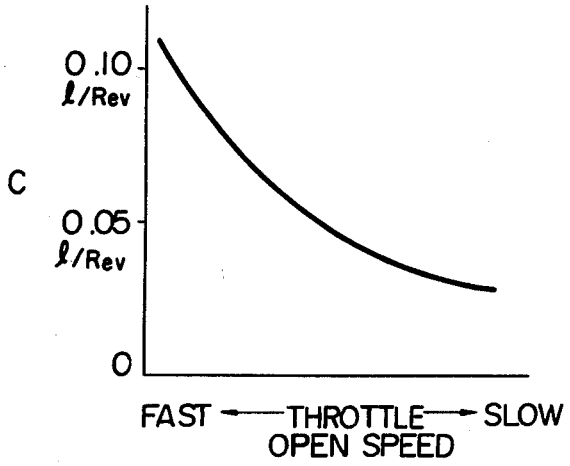
FIG. 11 is a graph of the increment factor C versus the open speed of the throttle valve.

At the point 53, if it is discriminated that the restriction control flag is on, the program proceeds to a point 73. At the point 73, a variable increment factor C is calculated from the opening speed of throttle valve 11. The throttle opening speed is obtained by differentiating the data which corresponds to the degree of the opening of the throttle valve 11 and is detected by the throttle sensor 12, with respect to time. In the ROM 46, a function representing a relationship between the variable increment factor C and the throttle opening speed, as shown in FIG. 11, was previously stored in the form of an algebraic expression or map. The factor C is calculated by using this function. Then at a point 74, the restriction value $VE_{re}$ is increased by the calculated increment factor C. Thereafter, the program proceeds to the point 55 of FIG. 4.

According to the above-mentioned processing routine of FIG. 8, the lower the coolant temperature, the greater the initial value $VE_{reo}$ of the restriction value $VE_{re}$ which is determined by the processing at the points 70 and 72. Therefore, the air-fuel ratio condition becomes rich and, thus, much torque can be obtained at the accelerating operation, when the engine temperature is low (during warming-up). According to the processing routine of FIG. 8, the initial value $VE_{reo}$ of the restriction value $VE_{re}$ is also increased during a low rotational speed, at the points 71 and 72. As a result, during a low speed, much torque can be obtained to cause the accelerating feeling to become good. Furthermore, according to the processing routine of FIG. 8, the increment factor C is increased, depending upon the increase of the throttle opening speed, at the point 73. Therefore, when the acceleration is fast, the changing rate of the volumetric efficiency is increased but within the limit rate, to cause the response of the engine to advance.

As will be apparent from the foregoing explanation, according to the present invention, since the changing rate of the volumetric efficiency is restricted to a limit value, rich spikes can be prevented from occurring when the intake air flow rate rapidly increases. As a result, the magnitude of the acceleration shock can be reduced and the amount of HC and CO components emitted from the engine can be reduced when the intake air flow rate rapidly increases.

As many widely difference embodiments of the present invention may be constructed without departing from the spirit and scope of the present invention, it should be understood that the present invention is not limited to the specific embodiments described in this specification, except as defined in the appended claims.

We claim:

1. An apparatus for controlling the amount of fuel injected into an internal combustion engine, comprising:

means for detecting the flow rate of intake air sucked into the engine to produce a first electrical signal which indicates the detected flow rate;

means for detecting the rotational speed of the engine to produce a second electrical signal which indicates the detected rotational speed;

processing means for (1) calculating, in response to said first and second electrical signals, the volumetric efficiency of the engine, (2) discriminating whether or not said calculated volumetric efficiency is equal to or greater than an upper setting value, and (3) restricting the changing rate of said calculated volumetric efficiency with respect to time within a limit rate, said restriction being executed only when it is discriminated that said calculated volumetric efficiency is equal to or greater than an upper setting value; and means for adjusting, in response to said calculated or restricted volumetric efficiency, the amount of fuel to be injected into the engine.

2. An apparatus as claimed in claim 1, wherein said limit value, with respect to the calculated volumetric efficiency, is determined in response to the operating condition of the engine.

3. An apparatus as claimed in claim 2, wherein said operating condition is indicated by the rotational speed of the engine and by the coolant temperature of the engine.

4. An apparatus as claimed in claim 1, 2 or 3, wherein said limit rate with respect to the changing rate of the volumetric efficiency is determined in response to the operating condition of the engine.

5. An apparatus as claimed in claim 4, wherein the engine has a throttle valve and said operating condition is indicated by the opening speed of the throttle valve.

* * * * *